US008590177B1

(12) United States Patent
Quaeck

(10) Patent No.: US 8,590,177 B1
(45) Date of Patent: Nov. 26, 2013

(54) FASTENING SYSTEM OF A MINI CRAMPON TO A SKI MOUNTAINEERING/ALPINE TOURING (AT) SKI BOOT

(71) Applicant: Manfred W. Quaeck, Sammamish, WA (US)

(72) Inventor: Manfred W. Quaeck, Sammamish, WA (US)

( * ) Notice: Subject to any disclaimer, the term of this patent is extended or adjusted under 35 U.S.C. 154(b) by 0 days.

(21) Appl. No.: 13/781,507

(22) Filed: Feb. 28, 2013

(51) Int. Cl.
*A43C 15/06* (2006.01)

(52) U.S. Cl.
USPC ..... 36/59 R; 36/62; 36/64; 36/132

(58) Field of Classification Search
USPC ..... 36/59 R, 61–66, 113, 132, 136
See application file for complete search history.

(56) References Cited

U.S. PATENT DOCUMENTS

| | | | | | |
|---|---|---|---|---|---|
| 1,031,426 | A * | 7/1912 | Czel | 36/65 |
| 1,136,112 | A * | 4/1915 | Fecko | 36/65 |
| 1,175,485 | A * | 3/1916 | Szakacs | 36/65 |
| 2,107,617 | A * | 2/1938 | Oetterer | 36/62 |
| 2,876,563 | A * | 3/1959 | Aitken | 36/7.7 |
| 2,888,754 | A * | 6/1959 | Miller | 36/7.7 |
| 3,156,988 | A * | 11/1964 | Rause | 36/81 |
| 3,685,173 | A * | 8/1972 | Piazza | 36/7.6 |
| 3,973,338 | A * | 8/1976 | Schwemmer et al. | 36/65 |
| 4,702,020 | A * | 10/1987 | Kroeger | 36/11.5 |
| 6,964,118 | B2 * | 11/2005 | Parisotto et al. | 36/7.6 |
| 2008/0000103 | A1 * | 1/2008 | Rastegar et al. | 36/62 |
| 2008/0022560 | A1 * | 1/2008 | Grimmeisen | 36/114 |

* cited by examiner

*Primary Examiner* — Marie Patterson

(57) ABSTRACT

The mini crampon is secured to a ski mountaineering/AT boot containing a special binding insert molded into the sole of the AT boot, and at least two trunnion pins, and at least one stop bumper retained in the mini crampon, which engage the binding insert in the AT boot sole securing the mini crampon to the AT boot.

7 Claims, 4 Drawing Sheets

FASTENING SYSTEM OF A MINI CRAMPON TO A SKI MOUNTAINEERING/ALPINE TOURING (AT) SKI BOOT

CROSS REFERENCE TO RELATED APPLICATION

This application claims priority to and benefit of the USA Design patent application 'Crampon for "tech" style ski mountaineering boot' No. 29/374,515 filed Aug. 25, 2011 and the European Design Patent Application 'Steigeisen' #002016246-0 filed on Mar. 28, 2012.

BACKGROUND OF THE INVENTION

1. Field

The subject of the invention is in the field of ski mountaineering/randonee skiing. In ski mountaineering the preferred way to climb a mountain is with the skis attached to your ski boots. To do this efficiently the skier uses special ski mountaineering boots, ski bindings, and climbing skins, which attach to the skis. In difficult snow conditions, like hard frozen snow and icy conditions, special ski crampons are used to navigate and safely climb the mountain. These ski crampons attach either directly to the skis or mount directly to the binding system being used. But all of these devices have limitation in very steep terrain and frozen, icy snow conditions. In these situations the skis have to be removed and carried up the slope. For these conditions the ski mountaineer needs crampons, which mount to the bottom of the ski mountaineering boot for safe climbing. Most crampons cover the full length of the boot sole and are fixed to the ski boot by means of 'U-shaped' front fastening bracket and rear fastening device.

2. Prior Art

There is much prior art in the particular field of crampon design, and the relative fastening method to the ski mountaineering boots. The US patents and patent application listed here are typical examples:

1. U.S. Pat. No. 4,480,396
2. U.S. Pat. No. 6,964,118
3. 2012/0066939

U.S. Pat. No. 4,480,396 shows the most common crampon attachment means to the AT boot. U.S. Pat. No. 6,964,118 shows an interface of a special designed hiking boot with a crampon. The front of the hiking boot and front of the crampon are designed to connect with each other by special connection means. The rear fastening device is the same as in patent 1.

Patent application 2012/0066939 shows a crampon fastening system to an AT boot. This boot is designed to be used with a special binding system that is designed to engage with the binding fastening system provide in the heel portion of the boot as shown in FIG. 4 of the application. The front portion of the crampon uses a 'U-shaped' bracket as fastening means to the boot. The drawback of these crampons is their weight and size, and their full features are not needed in many situations. Especially in steep terrain only the front portion of the crampon is used. Thus the need exists for a light and small crampon that can easily be stored and carried in the backpack.

SUMMARY OF THE INVENTION

The purpose of the present invention is to provide a crampon that is light and small and interfaces with a binding insert, which is an integral part of the AT ski boot. To achieve this, this present invention has a minimum of two trunnion pins, integral to said crampon located at opposite sides of the crampon. These trunnion pins are arranged at a common horizontal axis, and thus align with the fastening seats formed in the binding insert, which is rigidly molded into the boot sole at the front of an AT boot. According to the present invention one of the trunnion pins is adjustable along the common horizontal axis to engage with the fastening seat formed in the binding insert, so as to secure said crampon to said AT ski boot. According to the present invention there is also provided a bumper carrier at the front of the crampon located between the two front points. This bumper carrier which is an integral part of the crampon is bent perpendicular to the base of the crampon. An adjustable stop bumper is mounted to the bumper carrier and rest against the front of the boot above the sole to prevent the crampon from rotating around the axis of the trunnion pins. The invention is described in more detail below with reference to the attached drawings.

DETAILED DESCRIPTION OF THE INVENTION

Figure 1:
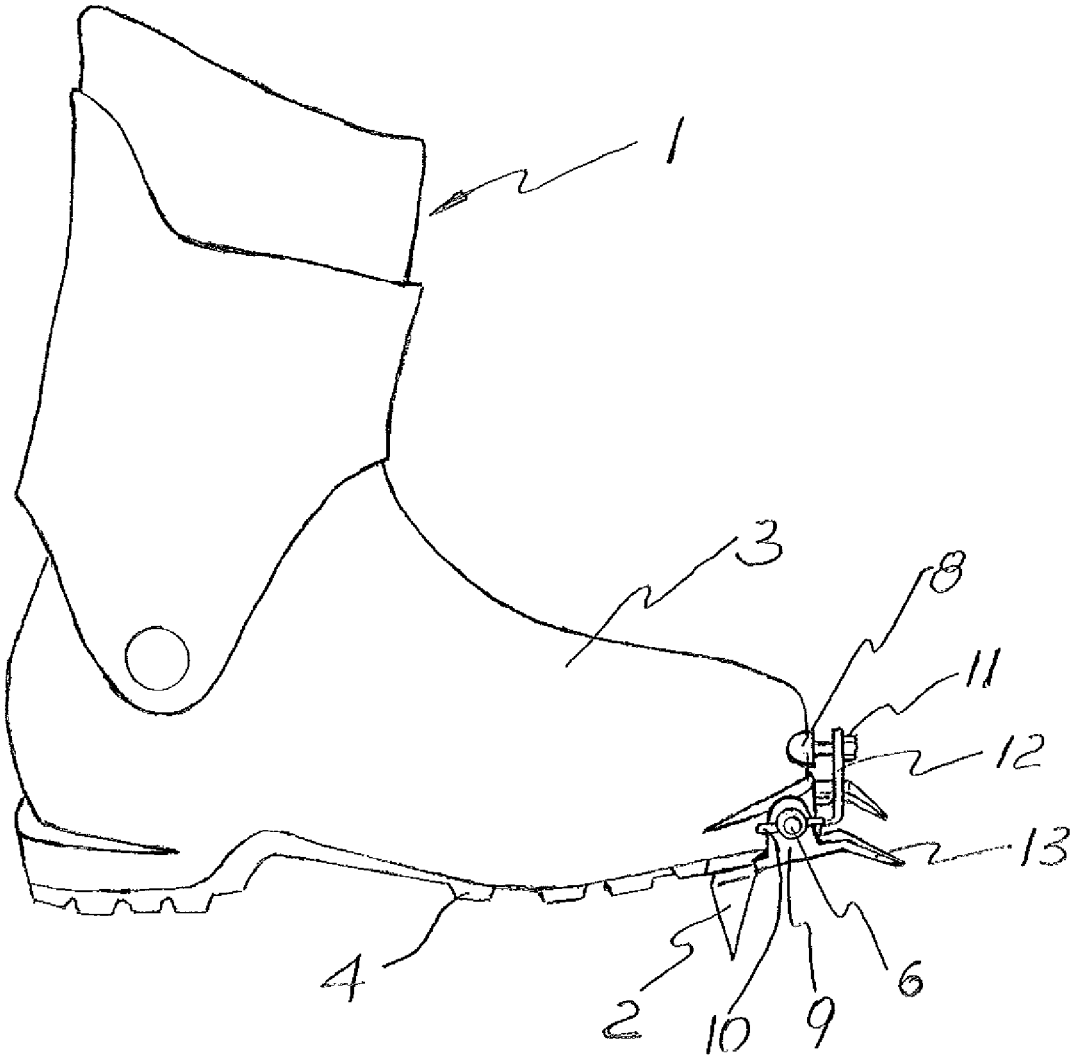
FIG. 1 shows a side view in perspective of a ski mountaineering boot with the mini crampon attached in accordance with present invention.
Figure 2:
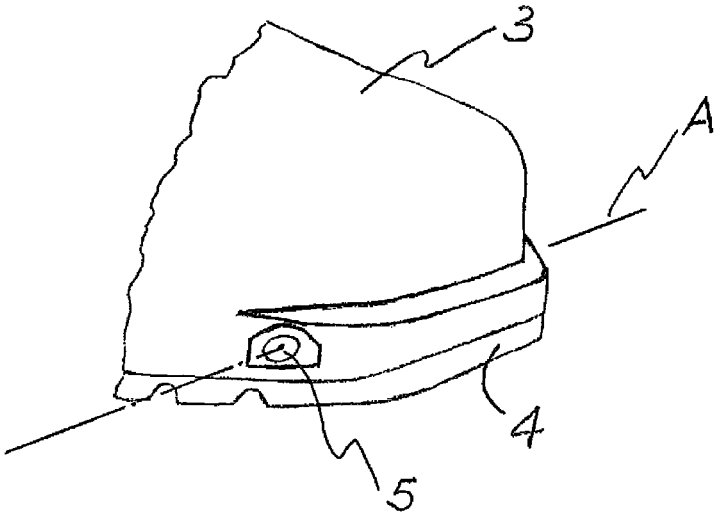
FIG. 2 is a schematic partial front portion of the ski mountaineering boot with a binding insert installed.
Figure 3:
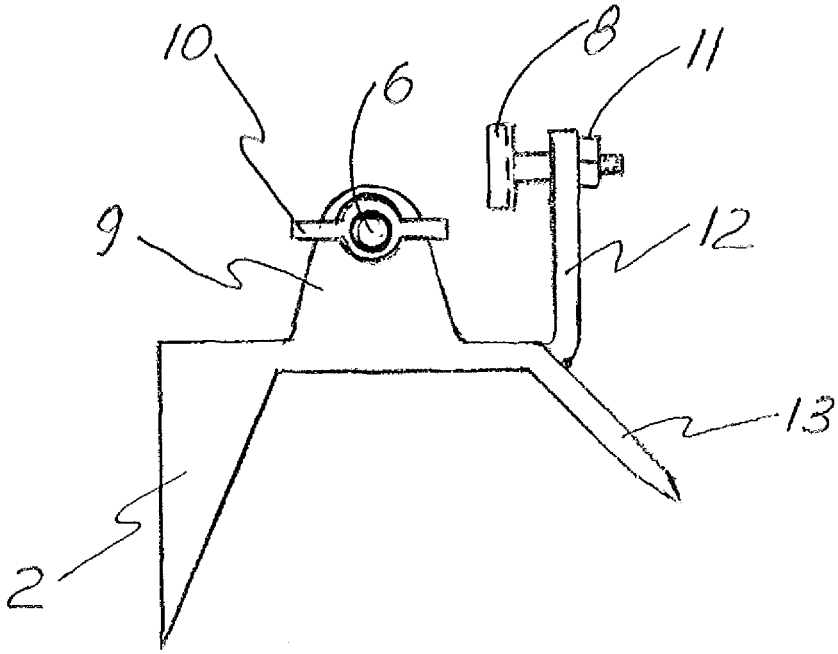
FIG. 3 is a side view in perspective of the mini crampon.
Figure 4:
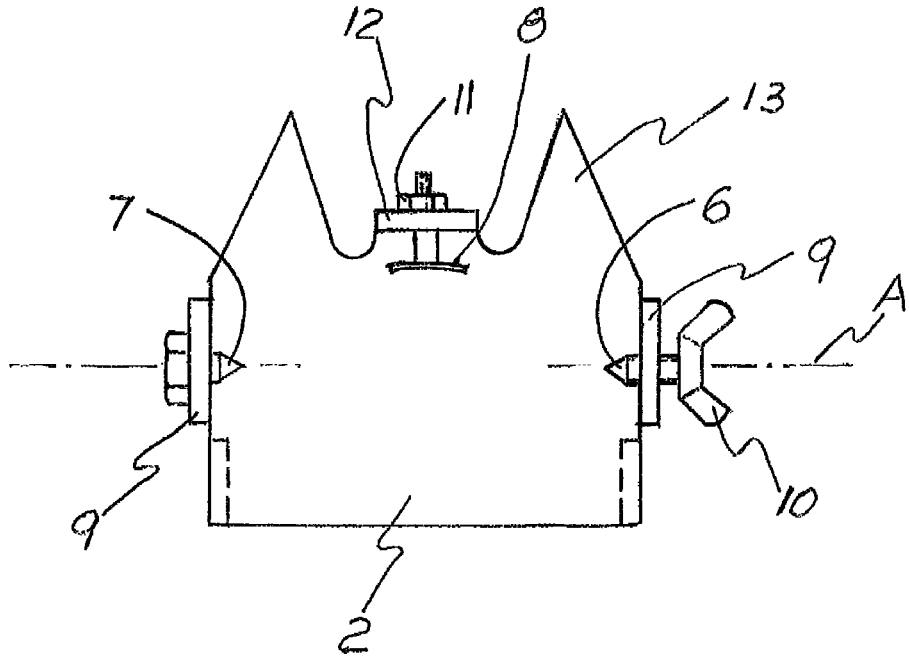
FIG. 4 is a top view in perspective of the mini crampon.

Number 1 and 2 in FIG. 1 show a ski mountaineering boot and a mini crampon connected to each other by a fastening systems described in detail below. Ski mountaineering boot 1 comprised of an upper portion 3 and a sole 4, which has embedded a least two conical mounting seats 5 positioned at a common axis A on the right and left side of said sole 4 FIG. 2. Said mounting seats 5 facilitates the fastening of the mini crampon 2 to ski boot 1 using trunnion pins 6 and trunnion pin 7 FIG. 4. Trunnion pin 6 is adjustable mounted in trunnion ear 9 along common axis A by means of rotational movement facilitated by wing shaped member 10. To prevent the rotational movement of the mini crampon around axis A an adjustable stop bumper 8 is mounted in the bumper carrier 12 FIG. 3 & FIG. 4 located between the front points 13. This stop bumper 8 is adjusted so as to make contact with the upper portion 3 of the ski boot 1 and thus provides a third element for the secure mounting of the mini crampon. Nut 11 safely secures the stop bumper 8 after adjusting said stop bumper 8 to fit the different ski mountaineering boots.

The embodiments which are illustrated and described are presented to serve as examples of the invention. They also constitute the best modes known to me at this time. However, my scope of protection is not to be limited by the details of this embodiment, but rather is to be determined by the claims that follow, interpreted in accordance with established rules of patent claim interpretation, including use of the doctrine of equivalence.

I claim:

1. A mini crampon fastening system, comprising:

a metal insert contained by front part of a ski boot;

a crampon configured to fasten to the metal insert of the front part of the ski boot to aid in walking on a steep terrain, the crampon further comprising:

at least two opposing vertical trunnion ears (9) and one vertical front bumper carrier (12), where said opposing trunnion ears (9) carry at least two opposing trunnion pins (6) and (7) suitable to engage fastening seats (5) of front left and right sides of the boot (4), and at least one stop bumper (8) mounted in vertical front bumper carrier (12) suitable to engage upper portion (3) of ski boot (1).

2. A fastening system as claimed in claim 1 including at least one of the trunnion pin adjustably mounted in said trunnion ear (9) along an axis.

3. A fastening system as claimed in claim 1 including at least one of the trunnion pin adjustably mounted in said trunnion ear (9) along axis A.

4. A fastening system as claimed in claim 1 wherein the crampon is configured to be removably attachable to a mountaineering boot comprised of an upper portion and a sole, which has embedded at least two conical mounting seats positioned at a common axis on the right and left side of the sole, and further wherein the mounting seats facilitate fastening of the crampon to the mountaineering boot using one or more of the trunnion pins.

5. A fastening system as claimed in claim 1 wherein the one or more of the trunnion pins are adjustably mounted in trunnion ear along a common axis A by means of a rotational movement facilitated by a wing shaped member.

6. A fastening system as claimed in claim 5 wherein the rotational movement around the axis A is prevented by an adjustable stop bumper mounted in a bumper carrier, and further wherein the stop bumper is adjustable to make contact to upper portion of the boot to provide an element for secure attachment of the crampon.

7. A fastening system a claimed in claim 1 is configured to be fastened to a binding insert molded into the front part of a sole of a skiing AT boot.

* * * * *